United States Patent [19]

Inoue

[11] 4,326,401

[45] Apr. 27, 1982

[54] APPARATUS FOR REVERSE REDRAWING

[75] Inventor: Kenichi Inoue, Ibaragi, Japan

[73] Assignee: Daiwa Can Company, Ltd., Japan

[21] Appl. No.: 134,972

[22] Filed: Mar. 28, 1980

[51] Int. Cl.[3] ..... B21D 22/00

[52] U.S. Cl. ..... 72/350; 72/347; 72/377

[58] Field of Search ..... 72/347, 348, 349, 377, 72/350, 351

[56] References Cited

U.S. PATENT DOCUMENTS 1,649,841 11/1927 May ..... 72/347

3,314,274 4/1967 Langeuis ..... 72/349

3,678,725 7/1972 Langeuis ..... 72/348 X 4,036,056 7/1977 Saunders ..... 72/350 X

*Primary Examiner*—Leon Gilden

*Attorney, Agent, or Firm*—Daley & Brandt

[57] ABSTRACT

An apparatus for reverse redrawing of a cup is provided with an annular ring surrounding the upper end periphery of body portion of a die ring, provided concentrically with the die ring, a slightly larger clearance than the wall thickness of the cup to be redrawn being provided between the inside surface of the annular ring and the outside surface of the die ring.

1 Claim, 8 Drawing Figures

APPARATUS FOR REVERSE REDRAWING

BACKGROUND OF THE INVENTION

The present invention relates to an apparatus for reverse redrawing of a cup in a system for producing the so-called two-piece metallic can having an integrated can body and can bottom by drawing or both drawing and ironing.

The two-piece metallic can is usually produced by blanking a disc from a metallic sheet, drawing the disc into a cup, and redrawing the cup, and, if necessary, ironing the cup, thereby obtaining a desired can height. Among these steps, the redrawing of a cup is carried out according to the following reverse redrawing method shown in FIG. 1. That is, a cup 1 is crowned on a die ring 2 so that the inside surface of body portion 11 of cup 1 can be in contact with the outside surface 24 of ring body portion 21 of die ring 2, and the bottom of cup 1 is pressed into the inside of die ring 2 by a punch 3 so that the face side and the back side of cup 1 can be reversed, whereby the diameter of cup 1 is reduced. When the cup is reversingly redrawn according to said method, it is known that longitudinal wrinkles 13 are developed at the open end 12 of reversingly redrawn cup 1', as shown in FIG. 2, unless a press device or a blank holder for pressing the body portion of the cup 1 on an upper surface of the die ring, is used in the case the thickness of body portion 11 of cup 1 is thin.

One example of the well known press device is shown in FIG. 3. and the press device has pressure ring 4 of a hollow cylinder being provided concentrically with punch 3 and having a lower end 41 with a concavely curved surface matching the convexly curved surface of upper end 22 of die ring 2 and an inner diameter substantially equal to the outer diameter of punch 3. Pressure ring 4 is made to move down toward die ring 2 in a vertical direction before punch 3 moves down and holds cup 1 between lower end 41 and upper end 22 of die ring 2.

Another press device is shown in FIG. 4. A horizontally movable press device comprised of a plurality of horizontally movable members 5 is provided at a definite distance of upper end 22 of die ring 2. When cup 1 is pressed onto die ring 2, tip end 12 of body portion 11 of cup 1 slides down against slope 51 on horizontally movable members 5, and thus the members 5 of press device are pushed away outwardly, and then cup 1 is crowned on die ring 2. After the crowning of cup 1, the members 5 of horizontally movable press device as pushed away outwardly get together against toward the center and recover the original shape. At that time, the members 5 are positioned as near as possible to the upper surface of bottom 15 of cup 1 and functions to prevent development of wrinkles.

However, the conventional press devices shown in FIGS. 3 and 4 are members of a vertically or horizontally reciprocating movable type, and thus have a complicated mechanical structure to move said members.

Furthermore, the conventional press devices are more liable to have damages or troubles due to mechanical wearing or repeated fatigue during the reciprocating movements, and thus are not suitable for high speed processing.

Furthermore, the press device shown in FIG. 3 has a particularly complicated mechanical structure, and thus has such disadvantages that much labor and time are required for replacement of die or adjustment, and the press device shown in FIG. 4 has such disadvantages that the drawing and ironing strokes are increased corresponding to the thickness of the members of the press device, and it takes more time in reciprocating the drawing and ironing punch, and when cup 1 is crowned onto die ring 2, the members 5 of press device are pushed away outwardly by tip end 16 of body portion 11 of cup 1, and sludge is liable to be deposited on the outer surface (as shown in FIG. 4) of cup 1 at that time, and when the cup is redrawn as such, sliding scars appear on the inner surface (the reversed outer surface) of the resulting redrawn product, and furthermore such a disadvantage that, when the members 5 of press device are pushed away outwardly by the tip end of cup body portion, the cup body portion may be deformed.

SUMMARY OF THE INVENTION

The present invention provides an apparatus for preventing development of wrinkles in reverse redrawing free from said disadvantages of the conventional apparatuses and suitable for high speed process.

According to the present invention, an apparatus for reverse redrawing of a cup by crowning the cup onto a die ring of hollow cylindrical body portion and pushing the bottom wall of the cup into the die ring by a punch, thereby effecting drawing while reversing the face side and the back side of the cup, characterized by an annular ring provided around the upper end portion of the body portion of the die ring at the outside of the die ring and concentrically with the die ring, a slightly larger clearance than the wall thickness of the body portion of cup being provided between the inside surface of the annular ring and the outside surface of the die ring.

PREFERRED EMBODIMENTS OF THE INVENTION

Figure 1:
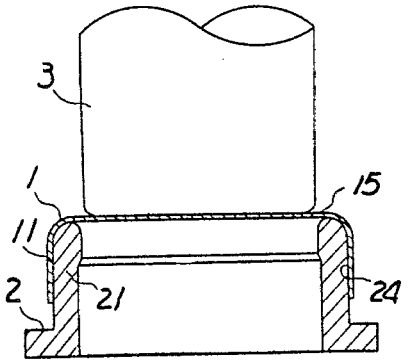
FIG. 1 is a partial cross-sectional view of an apparatus for reverse redrawing of a cup.
Figure 2:
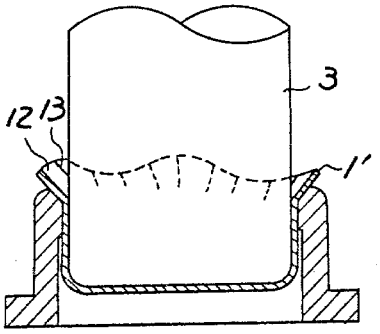
FIG. 2 is a partial cross-sectional view of the apparatus shown in FIG. 1 in operation.

The present invention will be described in detail below, referring to the drawings.

Figure 5:
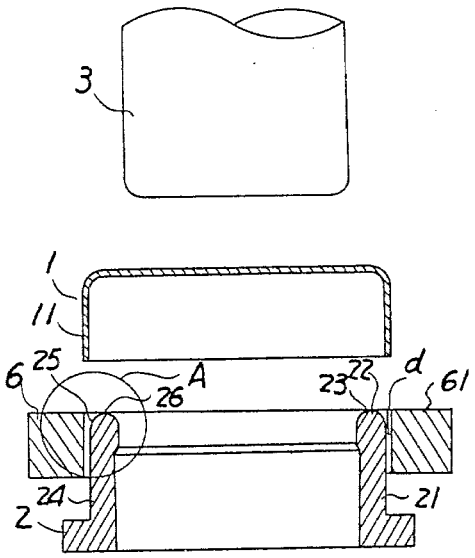
FIG. 5 is a partial cross-sectional view of the essential part of an apparatus for reverse redrawing according to the present invention, showing a fixed annular ring 6, and a positional relation of die ring 2, cup 1 and punch 3 before inserting cup 1 into the die ring.
Figure 6:
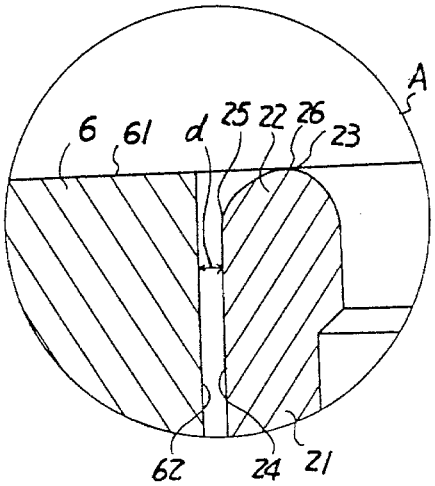
FIG. 6 is an enlarged cross-sectional view of part A of FIG. 5.

In FIGS. 5 and 6, an apparatus for reverse redrawing according to the present invention is shown, which comprises a cylindrical punch 3 and a die ring 2 of hollow cylinder having a smoothly convexly curved upper end 23 as used in the conventional reverse redrawing, and a fixed annular ring 6 surrounding upper end portion 22 of die ring 2 and being provided concentrically with die ring 2, a slightly larger clearance d than the wall thickness of body portion 11 of cup 1 being provided between the inside surface of said annular ring 6 and the outside surface of die ring 2.

The annular ring 6 has the inside surface 62 concentrical with the outside surface 24 of body portion 21 of die ring 2, and the inside surface 62 is extended upwardly over the upper end 25 of the cylindrical outside surface of die ring 2. The upper end surface 61 of the annular ring 6 is preferably at a level substantially equal to the uppermost point 26 of die ring 2.

Figure 7:
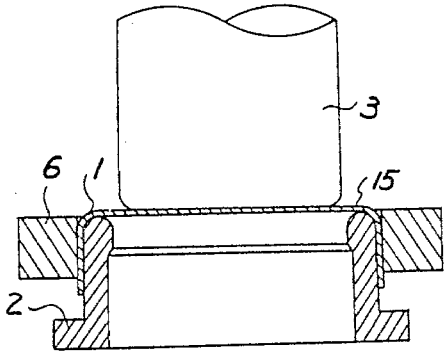
FIG. 7 is a partial cross-sectional view of the apparatus shown in FIG. 5 in operation, showing the moment of punch 3 to start reverse redrawing after cup 1 is crowned onto the die ring.

As shown in FIG. 7, the body portion 11 of cup 1 is inserted between the inside surface 62 of the annular ring 6 and the outside surface 24 of die ring 2 to crown cup 1 onto die ring 2. Then, as shown in FIG. 8, the bottom wall 15 of cup 1 is pushed into die ring 2 by punch 3 to apply reverse redrawing to cup 1.

Figure 3:
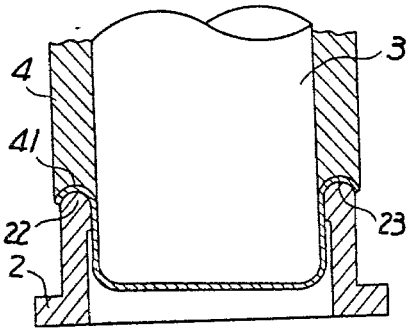
FIG. 3 is a partial cross-sectional view of the apparatus shown in FIG. 1, provided with a press device.
Figure 4:
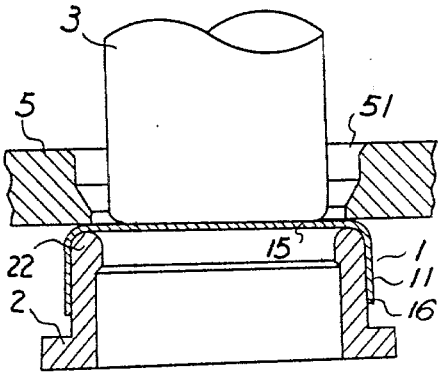
FIG. 4 is a partial cross-sectional view of the apparatus shown in FIG. 1, provided with another press device.
Figure 8:
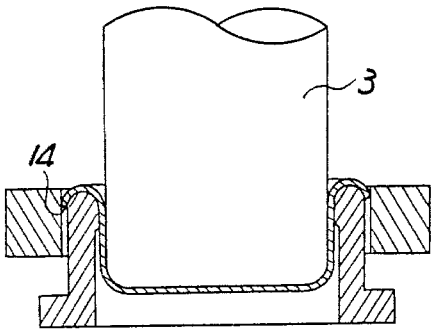
FIG. 8 is a partial cross-sectional view showing a state of reverse redrawing just before finishing according to the apparatus shown in FIG. 5.

If the annular ring 6 is not provided in the reverse redrawing, the open end portion of cup is raised apart from the die ring, when the cup is reversingly redrawn to a position somewhat above the level of the punch shown in FIG. 8, and the open end portion takes a funnel shape and longitudinal wrinkles develop in the funnel shaped portion by further redraw. If the open end portion of the cup is drawn along and in contact with the outside surface of die ring, no wrinkles are developed. This can be confirmed by the use of a press device shown in FIGS. 3 and 4.

The annular ring of the present invention has a function to make the body portion of cup move along and in contact with the outside surface of die ring until the open end 14 of cup reaches the upper end 25 of the cylindrical outside surface of die ring, as shown in FIG. 8, but after the open end 14 of cup has passed over the upper end 25 of the outside surface of die ring, the annular ring has no more function to move the open end of cup along the convexly curved surface of the upper end portion of die ring. In that case, development of wrinkles is expectable when the conventional press device is taken into account. However, no wrinkles are developed contrary to the expectation. The annular ring of the present invention has the so called wrinkle-preventing function.

Reverse redrawing by using the present annular ring will be described in detail below.

Cups, 78 mm in inner diameter, and 43 mm high in the case of aluminum cups, and 40 mm high in case of tin-plate steel cups were subjected to reverse redrawing by a die ring, 77.86 mm in outer diameter, without providing any press device. Longitudinal wrinkles were developed at 12–13 locations along the entire periphery within the distance of about 5 mm from the open end of reversingly redrawn cups.

However, when the reverse redrawing was applied to the aluminum cups by using the present annular ring, 79.10 mm in inner diameter, the tin-plate steel cups with the thickness of 0.34 mm by using the present annular ring, 78.90 mm in inner diameter, and tin-plate steel cups with the thickness of 0.32 mm by using the present annular ring, 78.70 mm in inner diameter, no wrinkles were developed at all.

A press device for reverse redrawing provided with an annular ring of very simple structure according to the present invention is very cheap, and the annular ring is easily exchangeable and also is of such a fixed type as to be free from disorder and has no adverse effect at all upon the punch stroke.

It will be apparent that various changes in form and details can be made to the method of the invention without departing from the spirit and scope thereof, the forms hereinbefore described being merely preferred embodiments thereof.

What is claimed is:

1. In apparatus for reverse redrawing of a cup having a bottom wall and a body portion, said apparatus including a die ring of hollow cylindrical body portion on which the cup can be crowned, and a punch for pushing the bottom wall of the cup into the die ring thereby effecting drawing while reversing the face side and the back side of the cup, the improvement of a fixed annular ring provided encirclingly around the upper end portion of the body portion of the die ring at the outside of the die ring and concentrically with the die ring, there being a clearance provided between the inside surface of the fixed annular ring and the outside surface of the die ring, said clearance being only slightly larger than the thickness of the cup body portion.

* * * * *